United States Patent [19]

Inoue et al.

[11] Patent Number: 4,886,997

[45] Date of Patent: Dec. 12, 1989

[54] COLOR PICTURE TUBE WITH SHADOW MASK SUPPORT ASSEMBLY

[75] Inventors: Masatsugu Inoue; Kiyoshi Tokita, both of Fukaya; Kazunori Nakane, Fukiage, all of Japan

[73] Assignee: Kabushiki Kaisha Toshiba, Kawasaki, Japan

[21] Appl. No.: 163,100

[22] Filed: Mar. 2, 1988

[30] Foreign Application Priority Data

Mar. 6, 1987 [JP] Japan ..... 62-50199

[51] Int. Cl.[4] ..... H01J 29/07

[52] U.S. Cl. ..... 313/406; 313/407

[58] Field of Search ..... 313/406, 404, 407

[56] References Cited

U.S. PATENT DOCUMENTS 3,487,251 12/1969 Barten et al. .
3,492,522 1/1970 Pappadis .
4,728,853 3/1988 Sone et al. ..... 313/406

FOREIGN PATENT DOCUMENTS 0207724 6/1986 European Pat. Off. .
159166 12/1979 Japan ..... 313/404
109344 8/1980 Japan ..... 313/406
1189403 4/1970 United Kingdom ..... 313/406

OTHER PUBLICATIONS

Patent Abstracts of Japan dated Mar. 24, 1987, vol. 11, No. 92, (E-491) (2539).

*Primary Examiner*—Palmer C. DeMeo
*Attorney, Agent, or Firm*—Cushman, Darby & Cushman

[57] ABSTRACT

A color picture tube of this invention has a CRT envelope having a substantially rectangular front panel, a phosphor screen formed on an inner surface of the front panel, a shadow mask which is detachably mounted on the panel adjacent to the phosphor screen by a supporting assembly, and a frame surrounding the shadow mask. The supporting assembly has a plurality of stud pins which project from the four corners of the front panel and leaf springs which are fixed at one end to a corresponding corner of the frame are detachably engaged at the other end with a corresponding stud pin. Each leaf spring has an elastically deformable portion between one end portion fixed to the frame and the other end portion engaged with the corresponding one of the stud pins. Angle $\beta$, defined by the axis of the elastically deformable portion a central line axis of the CRT envelope, and angle $\alpha$, defined by a line connecting an end portion of the elastically deformable portion on the side of the frame and the stud pin and the central line axis of the CRT envelope, have the following relation: $\beta < \alpha$

11 Claims, 5 Drawing Sheets

COLOR PICTURE TUBE WITH SHADOW MASK SUPPORT ASSEMBLY

BACKGROUND OF THE INVENTION

1. Field of the Invention

The present invention relates to a color picture tube and, more particularly, to a supporting assembly for connecting a shadow mask to the front panel of a color picture tube.

2. Description of the Related Art

A color picture tube comprises three electron guns, a front panel, a phosphor screen formed on the inner surface of the front panel, a rigid mask frame, and a shadow mask supported by the rigid mask frame and facing the phosphor screen. The shadow mask has a plurality of apertures through which electron beams emitted from the guns pass before striking the phosphor screen. The rigid mask frame surrounds the peripheral edge of the shadow mask, thus maintaining the shape of the shadow mask. The color picture tube further comprises a supporting assembly which supports the mask frame. The mask frame can be detached from the supporting assembly, as can the shadow mask.

As a result of the electron beam passing through the apertures of the shadow mask for some time, the shadow mask becomes heated and expands, which causes the positions of the individual apertures to change. This inevitably gives rise to an undesirable phenomenon known as "doming", i.e., the mislanding of the beams. To compensate for the thermal expansion of the mask, a bimetal is incorporated in the supporting assembly. This bimetal functions to move the shadow mask as the mask thermally expands, so that the electron beams passing through the apertures of the mask can land on the desired portions of the phosphor screen. However, the bimetal cannot move the shadow mask sufficiently quickly after the mask has begun to thermally expanded, and thus mislanding of the beam occurs. Besides, incorporating the bimetal, which is relatively heavy, renders the picture tube undesirably heavy.

Japanese patent Publication No. 46-4104 discloses a rectangular mask frame having four leaf springs which project from each of the four corners and are connected to the four corners of a shadow mask, thereby supporting the shadow mask. As a result, when the shadow mask thermally expands, deformation of the mask frame is less than that of the mask frame surrounding the shadow mask. The use of this mask frame results in the following advantages:

(1) Mislanding of the beams, does not occur in concentration at a particular portion of the phosphor screen.

(2) Mislanding of the beam, due to the vibration of the mask frame, is reduced since the springs absorb the vibration.

(3) The weight of the picture tube can be reduced significantly since the frame is thin and lightweight.

FIG. 1 shows a proposed assembly for supporting the shadow mask of a color picture tube, which is a combination made up of a stud pin 24 which projects from an inner peripheral wall of panel 11, and a leaf spring 2 having a hole through which stud pin 24 extends. Stud pin 24 is tapered at an angle of about 12°. Leaf spring 2 is composed of three portions, i.e., fixed portion 3, welded to frame 18 and located near phosphor screen 14; elastically deformable portion 4; and engaging portion 5, supported by stud pin 24, on its rear side, and located remote from screen 14. Leaf spring 2 has a substantially V-shaped longitudinal section. Ideally, the angle ($\theta$) defined by movable portion 4 and frame 18 should be 45° in the case of a picture tube having a beam deflection angle of 90°, and 35° in the case of a picture tube having a beam deflection angle of 110°, in order to compensate only for the mislanding of electron beams 15 which has resulted from the thermal expansion of shadow mask 17.

After the picture tube of either of the above types has been in continuous use for 30 minutes or more, frame 18 begins to expand due to beam heating. Since the diameter of frame 18 inevitably increases as a result of thermal expansion, allowing shadow mask 17 to move, as is shown in FIG. 1, apertures 19 of shadow mask 17 (indicated by a solid line) move in the radial direction of the picture tube. Nonetheless, leaf springs, which are inclined to shadow mask 17, push frame 18 toward phosphor screen 14, thus moving shadow mask 17 toward screen 14, whereby apertures 19 move to position **19*b*. Therefore, mislanding of the beams, resulting from the expansion of mask 17**, is reduced to some extent, with a corresponding decrease in what is known as color purity drift.

However, in a conventional supporting assembly, when frame 18 is displaced in the radial direction, as indicated by an alternate long and two short dashed line in FIG. 2, engaging portion 5 of spring 2 is inclined, and portion 4 is curved. For this reason, the shift amount of frame 18 in the axial direction becomes smaller than a design value. Thus, the mask assembly cannot be moved for a sufficiently long distance in the axial direction when spring 2 is attached to frame 18 at the above-mentioned angle. In this case, apertures 19 of mask 17 cannot be located at the desired positions.

Spring 2 is attached to frame 18 to have an angle $\theta$ larger than the above-mentioned value, e.g., to be about 70 degrees or more in a picture tube having a beam deflection angle of 90 degrees, so as to increase the shift amount of frame 18 by spring 2. However, if the angle $\theta$ is increased, the spring constant of spring 2 becomes too large, and it is difficult to detach shadow mask assembly from panel 11, resulting in a variety of problems in respect of manufacture and use.

More specifically, in manufacturing processes of a color picture tube, an attachment/detachment of a shadow mask to/from a panel must be repetitively performed. When leaf springs are used, the attachment-/detachment cannot be manually performed and must be performed by a special-purpose apparatus installed for each process. Furthermore, a large force acts on the supporting assembly, the mask frame, and the shadow mask during attachment/detachment of the shadow mask, and may deform these parts.

When such strong springs are used, spring 2 is fatigued upon several attachment/detachment operations, and an initial spring constant cannot be maintained. Therefore, it is difficult to precisely maintain the shadow mask assembly by means of the supporting assembly without the shadow mask assembly drifting in the panel.

The thermal expansion coefficient of a material constituting a stud pin must be substantially the same as that constituting the panel, in order to prevent the stud pin from cracking at the projecting portion. For this reason, as a material of the stud pin, an Fe-Cr alloy (Cr: 18 wt. %) is normally employed. This material is soft, i.e., has a Vickers hardness (Hv) of about 150. Leaf spring 2 is normally formed of hard stainless steel having an Hv of 380 to 500. When a rigid spring is used, the stud pin is recessed at a contacting portion, and mounting precision of the shadow mask is degraded.

Therefore, in the conventional supporting assembly, the mounting angle $\theta$ cannot be increased, and purity drift in a continuous operation for a long period of time cannot be satisfactorily compensated. Therefore, a deterioration of color purity near a peripheral region of the screen occurs.

SUMMARY OF THE INVENTION

The present invention has been made in consideration of the above situation and has as its object to provide a color picture tube which can satisfactorily compensate for purity drift occurring after extended use of the picture tube, and hence can improve image quality. It is another object of the present invention to provide a color picture tube wherein a shadow mask can be easily attached/detached to/from a front panel during its manufacture, without damage to the shadow mask parts.

The color picture tube of the present invention comprises a body having a substantially rectangular shape, a phosphor screen formed on an inner surface of the panel, a shadow mask which is detachably connected on the frame by a supporting assembly, and faces the phosphor screen, and a frame surrounding the shadow mask.

The supporting assembly has stud pins which respectively project from the four corners of said panel, and spring members, each of which is fixed at one end to a corresponding one of the four corners of the frame, and is engaged at the other end with the corresponding one of the stud pins when the shadow mask is mounted on the panel, and disengaged therefrom when the shadow mask is detached from the panel.

Each spring member has an elastically deformable portion between one end portion fixed to the frame and another end portion engaged with the corresponding one of the stud pins. Angle $\beta$ defined by the axis of elastically deformable portion and the central line axis of the body, as shown in FIG. 5, is less than angle $\alpha$ defined by a line connecting the end portion of the elastically deformable portion near the frame and the stud pin, and the central line axis of the body; that is: $\beta<\alpha$.

In this case, each spring member preferably has a substantially N-shaped longitudinal section.

In a picture tube having a beam deflection angle of 90 degrees, angle $\alpha$ preferably falls within the range of 60 to 80 degrees, and most preferably, 70 degrees. Angle $\beta$ preferably falls within the range of 45 to 65 degrees, and most preferably, 55 degrees.

In a picture tube having a beam deflection angle of 110 degrees, angle $\alpha$ preferably falls within the range of 50 to 70 degrees, and most preferably, 60 degrees. Angle $\beta$ preferably falls within the range of 35 to 55 degrees, and most preferably, 45 degrees.

The thickness of each spring member preferably falls within the range of 0.3 to 0.8 mm.

The thickness of the mask frame preferably falls within the range of 0.5 to 2.0 mm.

DETAILED DESCRIPTION OF THE PREFERRED EMBODIMENTS

Embodiments of the present invention will be described hereinafter with reference to the accompanying drawings.

Figure 1:
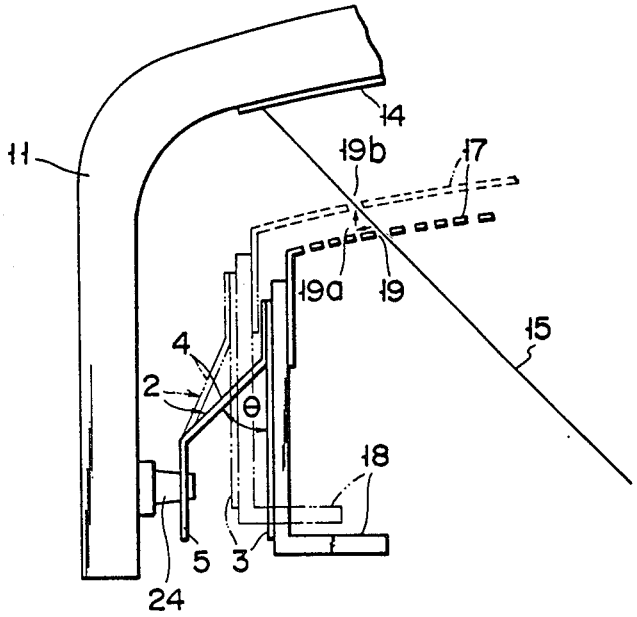
F I G. 1 PRIOR ART
FIGS. 1 and 2 are longitudinal sectional views of a supporting assembly of a shadow mask in a conventional color picture tube.
Figure 2:
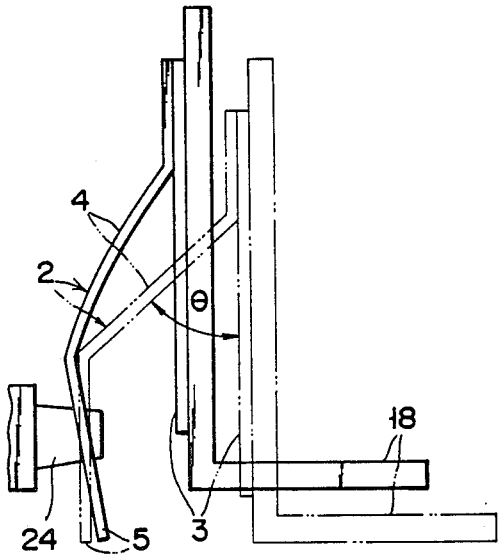
F I G. 2 PRIOR ART
Figure 3:
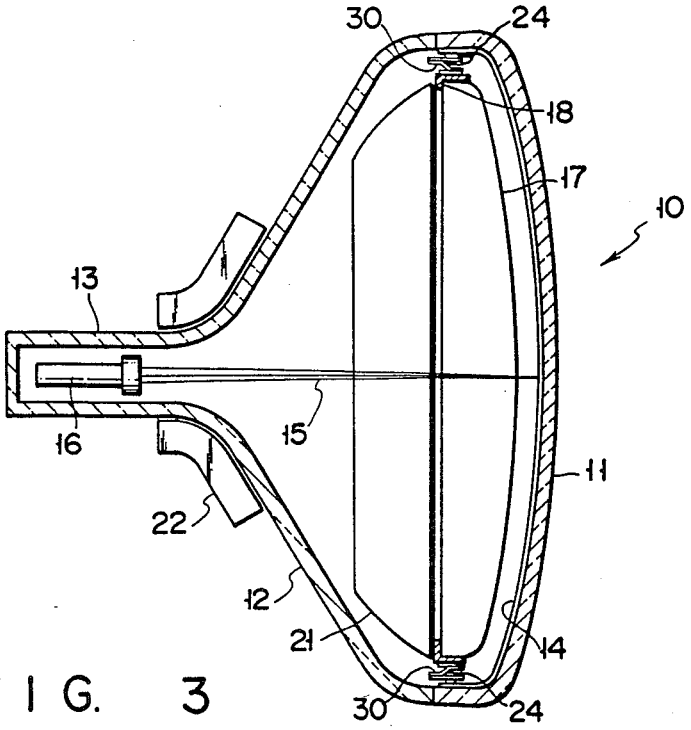
FIG. 3 is a longitudinal sectional view showing a color picture tube according to a first embodiment of the present invention.

As shown in FIG. 3, a vacuum envelope of color picture tube 10 is constituted by substantially rectangular panel 11, fan-shaped funnel 12, and neck 13.

Figure 4:
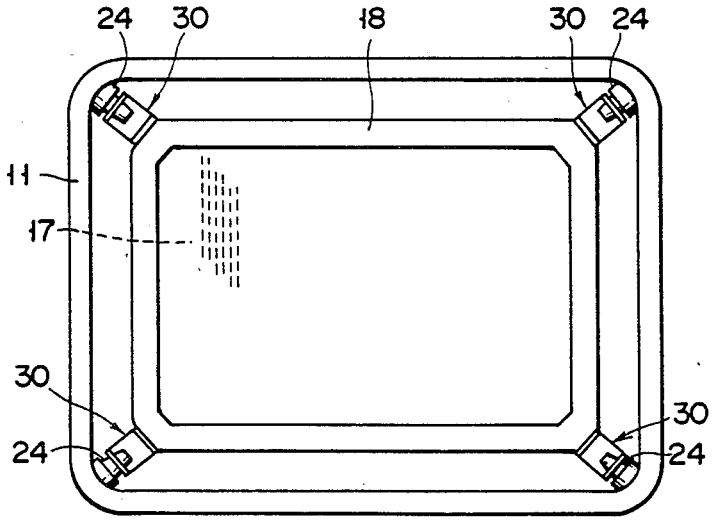
FIG. 4 is a schematic plan view of a color picture tube when viewed from the rearward.

Tri-color phosphor screen 14 consisting of stripe phosphor layers which emit red, green, and blue light, respectively, is deposited on the inner surface of panel 11. So-called inline type electron guns 16 which are aligned along the horizontal axis of panel 11 and emit three electron beams 15 corresponding to red, green, and blue, are disposed in neck 13. Shadow mask 17 in which a large number of slot apertures are formed is disposed to face phosphor screen 14. Substantially rectangular mask frame 18 is provided at the peripheral edge of shadow mask 17 so as to keep shadow mask 17 in position. Spring members 30 such as leaf springs, each having a through hole, are attached to the four corners of frame 18. The through holes of spring members 30 respectively receive stud pins 24 projecting from the four corners of the inner periphery of the panel 11 (FIG. 4). More specifically, when four spring members 30 are engaged with four stud pins 24, shadow mask 17 is supported inside panel 11 through frame 18.

Three inline electron beams 15 are deflected by deflection device 22 outside funnel 12, scan a rectangular region corresponding to panel 11, and land on stripe phosphor screen 14 while being color-separated through slot apertures of shadow mask 17, thereby reproducing a color image. In order to prevent the electron beams from being influenced by an external magnetic field, magnetic shield 21 is engaged inside funnel 12 through frame 18.

A supporting assembly of the first embodiment will be described in detail with reference to FIGS. 5 to 7. Shadow mask 17 is formed of a 0.2-mm thick cold-rolled steel plate containing iron as a major component, and its peripheral edge is fixed to mask frame 18. Mask frame 18 is formed of a 0.5-mm thick cold-rolled steel plate containing iron as a major component, and its axial section is L-shaped. Each spring member 30 has a substantially N-shaped section. Each spring member 30 is formed of a 0.4-mm thick precipitation-hardened stainless steel plate having good spring characteristics, e.g., an SUS 631 thin plate.

Figure 5:
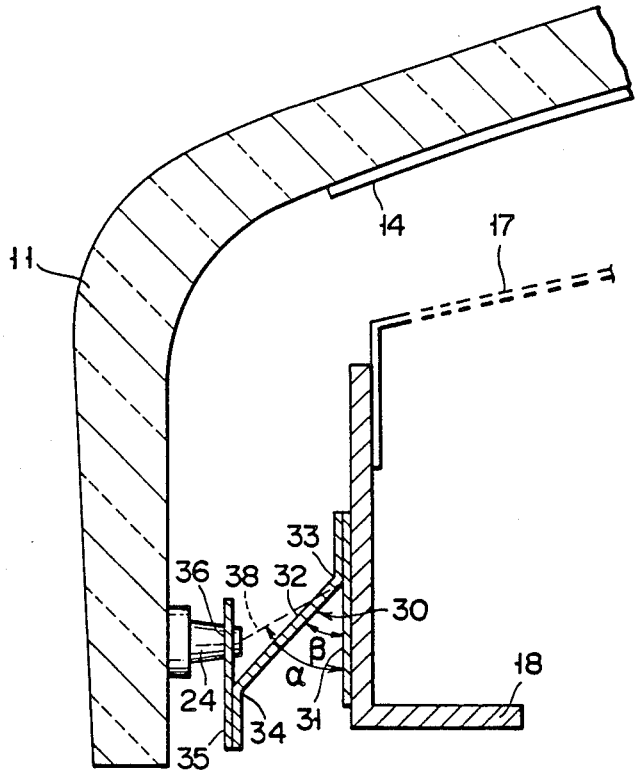
FIGS. 5 and 6 are longitudinal sectional views showing a supporting assembly of a shadow mask in a color picture tube according to the first embodiment of the present invention.
Figure 6:
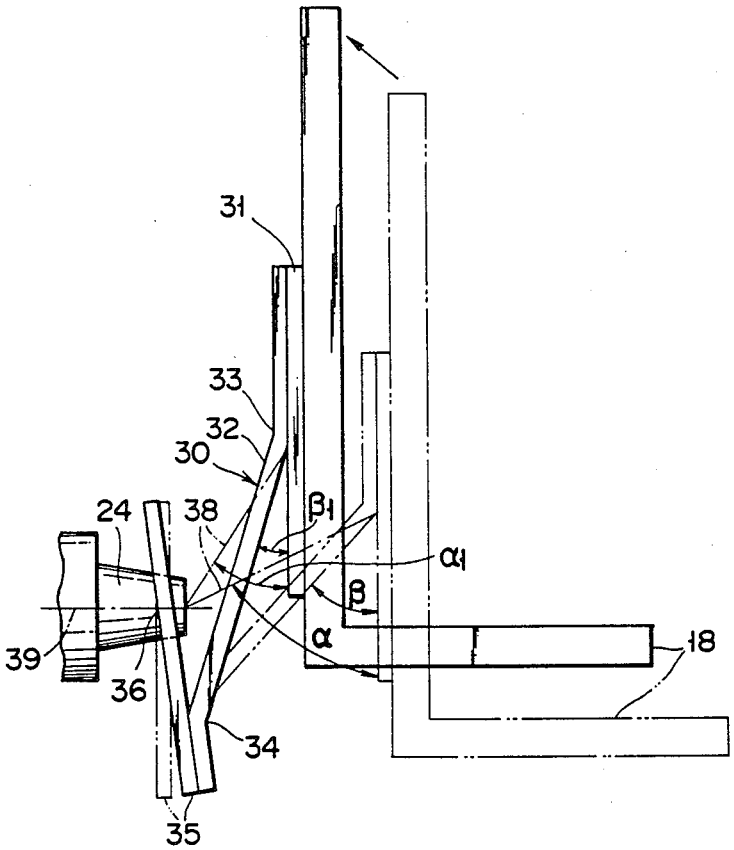

As shown in FIGS. 5 and 6, fixed portion 31 of each spring member 30 is fixed by welding it to the outer peripheral surface of frame 18. Movable portion 32 is formed by bending both ends of a thin plate through 55 degrees in opposite directions. One end of portion 32 is welded to an end portion (near phosphor screen 14) of fixed portion 31 and another end thereof is welded to an end portion (farther from phosphor screen 14) of engaging portion 35. More specifically, spring member 30 is attached so that angle $\beta$ defined by frame 18 and portion 32 is about 55 degrees. Hole 36 is formed at the center in the widthwise direction of engaging portion 35. When the shadow mask is attached to the panel, the distal end portion of each stud pin 24 is fitted in corresponding hole 36. In this case, angle $\alpha$ defined by line 38 connecting the distal end central portion of stud pin 24 and bent position 33 of portion 32, and the axis of body is about 70 degrees.

Stud pins 24 project from the inner periphery of glass panel 11. Each stud pin 24 has a frustoconical distal end portion, and is formed of a Cr-Fe alloy (Cr: 18 wt. %).

Figure 7:
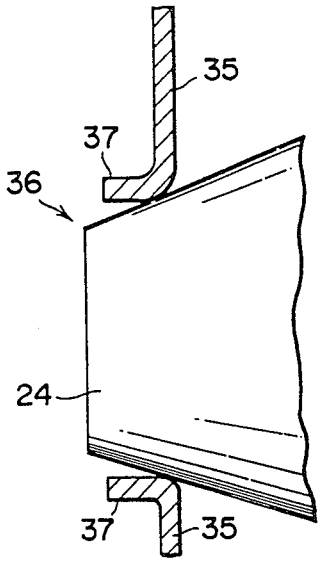
FIG. 7 is a view for explaining an engaging state between a spring member and a stud pin in the supporting assembly.

As shown in FIG. 7, collar 37 is formed around hole 36 of each engaging portion 35 substantially along the tapered surface of corresponding stud pin 24, so that stud pin 24 and engaging portion 35 are smoothly slid together.

A case will be described with reference to FIG. 6 wherein the color picture tube of the first embodiment is operated.

An alternate long and two short dashed line in FIG. 6 indicates the positions of the pertinent shadow mask assembly parts; before the operation is started, and a solid line indicates the positions after a predetermined period of time has passed from the beginning of the operation. Electron beam radiation conditions in this case are: an anode voltage of 25 kV, an anode current of 1,400 =A, and a radiation time of 90 minutes.

When electron beams are continuously radiated through the shadow mask, the shadow mask is thermally expanded in a short period of time. In a minute, mask frame 18 is heated, and the frame diameter is increased. When the diameter of frame 18 is increased by radiation for a long period of time, portion 32 of each spring member 30 is pushed toward corresponding stud pin 24, and is deformed to decrease initial angle $\beta$ to angle $\beta 1$. Thus, frame 18 is shifted toward the phosphor screen by a distance of $(\cos\beta 1 - \cos\beta)\times L$, and purity drift can be compensated for. Reference symbol L indicates a length between bent positions 33 to 34 of portion 32. In this case, spring member 30 is swung about hole 36 of engaging portion 35, and engaging portion 35 is inclined to compensate for the purity drift.

Since angle $\beta$ ($\beta 1$) is smaller than angle $\alpha$ ($\alpha 1$), the elastically deformable portion 32 is located between the frame 18 and the stud pin 24. Thus, a frame pressing force applied from first bent position 33 to portion 32 and a stud pin reaction force applied from second bent position 34 to portion 32 cancel each other. Portion 32, therefore, will remain straight without curving.

In this manner, since purity drift can be reliably compensated, a clear image can be obtained in a continuous operation for a long period of time. When a shock is applied, offsetting of the shadow mask can be appropriately compensated for by the leaf springs.

When angle $\alpha$ is increased, angle $\beta$ can be decreased while maintaining a predetermined shift amount (correction amount). Therefore, a leaf spring having a small spring constant can be employed, and spring fatigue can be effectively prevented. For this reason, a shadow mask can be easily attached/detached to/from the panel without damaging and deforming the parts.

Since the spring constant of the leaf spring can be smaller than that of the conventional one, the thickness of the mask frame can be decreased, and the picture tube can be rendered lightweight.

According to the first embodiment, in a conventional 21" color picture tube having a beam deflection angle of 90 degrees, beam mislanding of about 30 $\mu$m was found in the screen corner regions. However, according to the present invention, the mislanding can be substantially eliminated. For this reason, color purity in the screen corner regions is not deteriorated in a continuous operation for a long period of time, and a clear image can be obtained.

Figure 8:
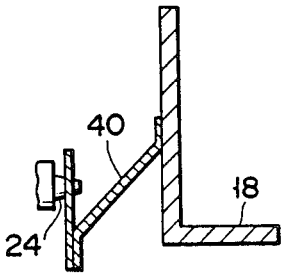
FIG. 8 is a longitudinal sectional view showing a supporting assembly according to a second embodiment.
Figure 9:
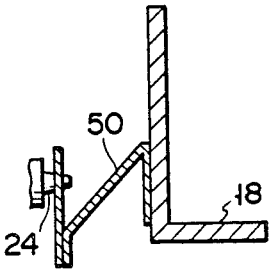
FIG. 9 is a longitudinal sectional view showing a supporting assembly according to a third embodiment.

As shown in FIGS. 8 and 9, in second and third embodiments each spring member includes by two plates. More specifically, in spring member 40 of the second embodiment, the fixed portion of the first embodiment is omitted, and the bent end portion of the movable portion is directly welded to frame 18.

In spring member 50 of the third embodiment, both ends of the elastically deformable portion are bent in an identical direction so that they are parallel to each other. More specifically, one end portion is bent at an angle of about 125 degrees, and the bent end portion is directly welded to frame 18.

Figure 10:
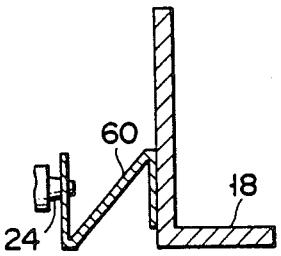
FIG. 10 is a longitudinal sectional view showing a supporting assembly according to a fourth embodiment.

As shown in FIG. 10, in the fourth embodiment, each spring member is constituted by a single plate. More specifically, in spring member 60, both ends of the elastically deformable portion are bent at a angle of about 125 degrees in opposite directions, and one bent end is directly welded to frame 18. A hole is formed in the other bent end portion to be engaged with the stud pin 24.

According to the second to fourth embodiments, the number of parts constituting the spring member can be decreased, thus improving productivity, and reducing cost.

What is claimed is:

1. A color picture tube comprising:

a CRT envelope having a substantially rectangular front panel and a central line axis;

a phosphor screen formed on an inner surface of said front panel;

a shadow mask assembly including (a) a shadow mask, (b) a supporting assembly detachably mounting the shadow mask on said front panel adjacent to said phosphor screen and (c) a frame surrounding said shadow mask, said supporting assembly comprising:

stud pins projecting from the four corners of said front panel, and spring members having two ends, one end being fixed to a corresponding one of the four corners of said frame and the other end being detachably engaged with a corresponding one of said stud pins, each said spring member including:

an elastically deformable portion located between said end fixed to said frame and said other end detachably engaged with the corresponding one of said stud pins, said elastically deformable portion and said central line axis of the CRT envelope defining an acute angle $\beta$ and a line connecting an end portion of said elastically deformable portion on the side of said frame with said stud pin and the central line axis of the CRT envelope defining an acute angle $\alpha$, wherein:

angle $\beta$<angle $\alpha$.

2. A tube according to claim 1, wherein each said spring member further includes:

a fixed portion fixed to said frame, and an engaged portion detachably engaged with said corresponding one of said stud pins, the fixed portion, elastically deformable portion, and engaged portion connected together to form a substantially N-shaped spring.

3. A tube according to claim 1, wherein each said spring member further includes:

an engaged portion detachably engaged with said corresponding one of said stud pins, the elastically deformable portion and engaged portion connected together to form a substantially V-shaped spring.

4. A tube according to claim 1, wherein each said spring member comprises a leaf spring including a plurality of thin plates.

5. A tube according to claim 1, wherein each said spring member comprises a leaf spring including a thin plate having a fixed end fixed to said frame and an engaged end engaged with said corresponding one of said stud pins, the fixed and engaged ends being bent in opposite directions relative to said thin plate and said fixed and engaged portions being parallel to each other.

6. A tube according to claim 1, wherein each said spring member comprises a leaf spring including a thin plate having a fixed end fixed to said frame and an engaged end engaged with said corresponding one of said stud pins, the fixed and engaged ends being bent in identical directions relative to said thin plate and said fixed and engaged portions being parallel to each other.

7. A tube according to claim 1, wherein each said spring member comprises a leaf spring including a single thin plate.

8. A tube according to claim 1, wherein said spring members including a free end portion having a through hole, said corresponding one of said stud pins being engaged in said through hole.

9. A tube according to claim 8, wherein each said stud pin comprises a frustoconical stud pin.

10. A tube according to claim 8, wherein said free end portion includes a peripheral edge portion surrounding said through hole, said peripheral edge portion being bent to form a collar.

11. A tube according to claim 1, wherein said spring members include a fixed end welded to said frame.

* * * * *